United States Patent [19]

Hansen

[11] 4,403,699

[45] Sep. 13, 1983

[54] HOLDING DEVICE FOR PENCILS AND THE LIKE

[76] Inventor: Robert S. Hansen, 2 E St., Santa Rosa, Calif. 95404

[21] Appl. No.: 874,415

[22] Filed: Feb. 2, 1978

[51] Int. Cl.[3] ..... A47F 7/00

[52] U.S. Cl. ..... 211/69.1; 47/41.13; D6/85

[58] Field of Search ..... 211/69.1–69.8, 211/120, 60 R, 60 G; 206/214, 371, 379; D19/81, 84, 85; 229/DIG. 3; 220/19; 47/41.13; 15/209 B

[56] References Cited

U.S. PATENT DOCUMENTS

| | | | |
|---|---|---|---|
| 692,406 | 2/1902 | Wright | 220/19 |
| 1,532,904 | 4/1925 | Kingman | 15/209 B |
| 2,193,727 | 3/1940 | Jouffray | 211/69.8 |
| 2,601,771 | 7/1952 | Cameron | 15/209 B X |
| 2,651,422 | 9/1953 | Erbguth | 211/69 |
| 2,929,511 | 3/1960 | Josephson | 211/120 X |
| 2,948,911 | 8/1960 | Steiner | 15/209 B |
| 3,418,194 | 12/1968 | Loftice | 248/27.8 X |
| 3,698,132 | 10/1972 | Green et al. | 47/41.13 |

*Primary Examiner*—Ramon S. Britts
*Assistant Examiner*—Robert W. Gibson, Jr.
*Attorney, Agent, or Firm*—Flehr, Hohbach, Test, Albritton & Herbert

[57] ABSTRACT

Device for holding pencils and other objects having elongated, generally rigid stems or bodies. The device comprises a base and a flexible mesh secured to the base for receiving the objects to be held in such manner that the bodies of the objects extend through the openings in the mesh and are gripped by the strands which define the openings.

9 Claims, 10 Drawing Figures

HOLDING DEVICE FOR PENCILS AND THE LIKE

BACKGROUND OF THE INVENTION

This invention pertains generally to supports and holders and more particularly to a device for holding pencils and other objects having elongated, generally rigid stems or bodies.

SUMMARY AND OBJECTS OF THE INVENTION

The holding device of the invention comprises a base and a flexible mesh secured to the base. The mesh has a plurality of intersecting strands with openings between the strands for receiving the objects in such manner that the bodies of the objects extend through the opening and are gripped by the strands which define the openings.

It is in general an object of the invention to provide a new an improved device for holding pencils and other objects having elongated stems or bodies.

Another object of the invention is to provide a holding device of the above character utilizing a flexible netting or mesh for holding the objects.

Additional objects and features of the invention will be apparent from the following description in which the preferred embodiments are set forth in detail in conjunction with the accompanying drawings.

DESCRIPTION OF THE PREFERRED EMBODIMENTS

Figure 1:
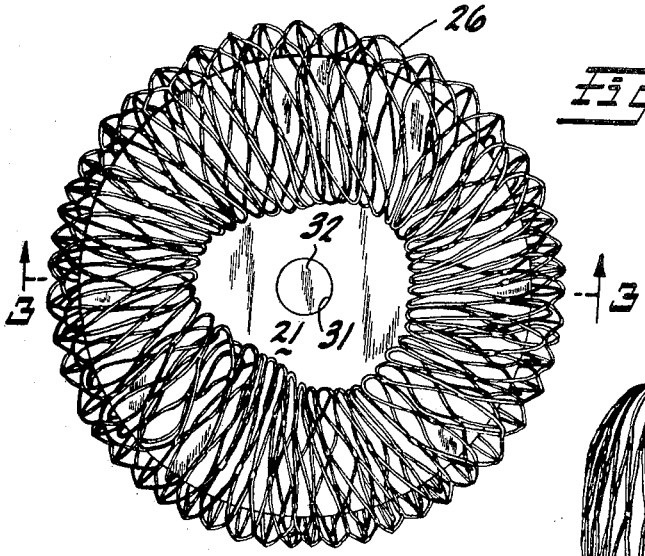
FIG. 1 is a top plan view of one embodiment of a holding device according to the invention.
Figure 2:
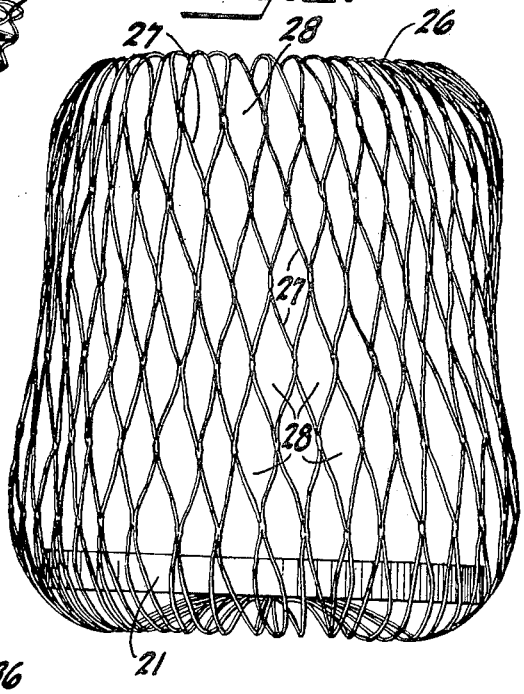
FIG. 2 is a side elevational view of the embodiment of FIG. 1.
Figure 3:
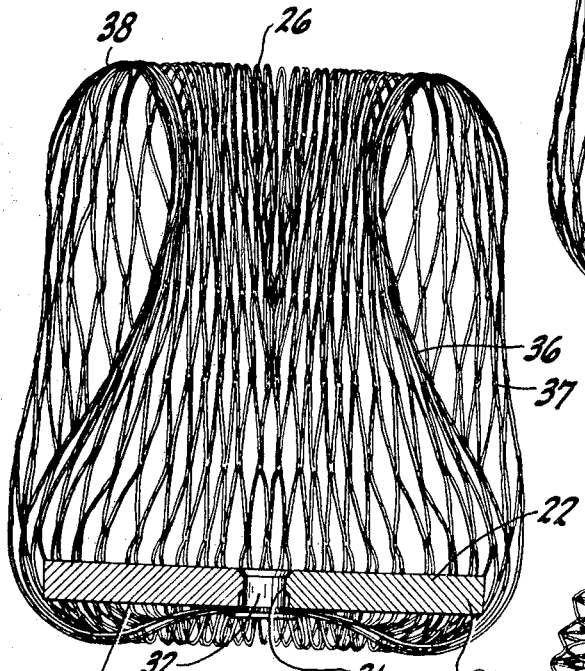
FIG. 3 is a vertical sectional view taken along line 3—3 of FIG. 1.
Figure 4:
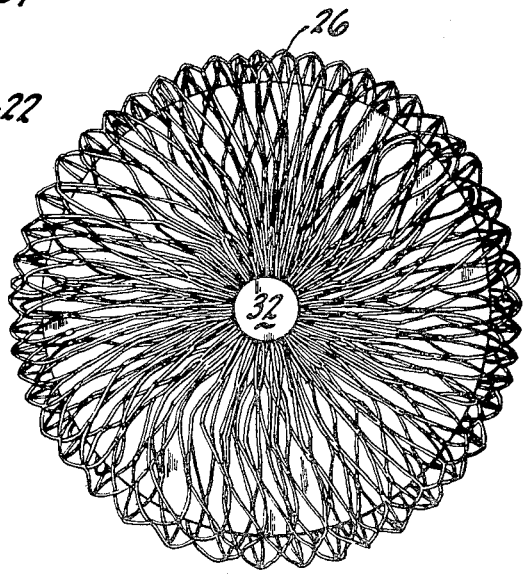
FIG. 4 is a bottom plan view of the embodiment of FIG. 1.
Figure 5:
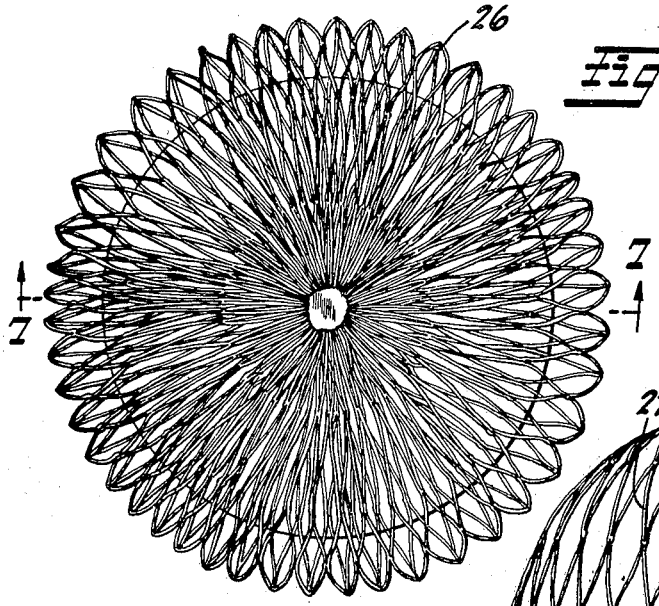
FIG. 5 is a top plan view of the holding device of FIG. 1 with the netting or mesh in an alternate position.
Figure 6:
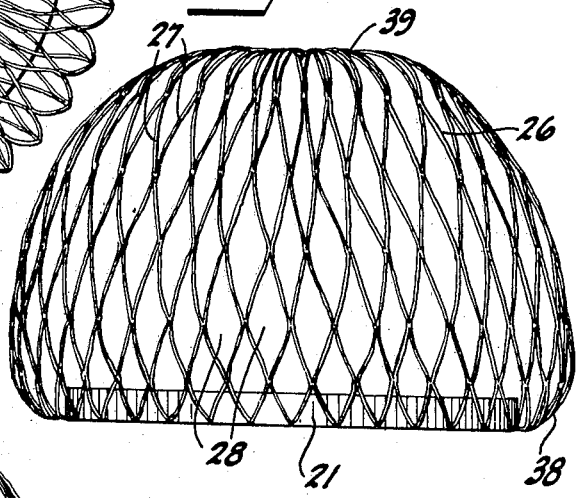
FIG. 6 is side elevational view of the holding device with the netting or mesh in the alternate postion.
Figure 7:
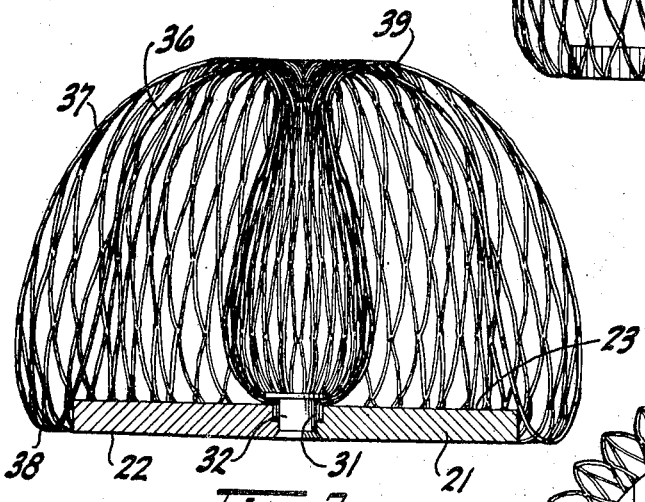
FIG. 7 is a vertical sectional view taken along line 7—7 of FIG. 5.

As illustrated in FIGS. 1–4, the holding device comprises a generally circular base 21 having generally planar surfaces 22, 23. The base is preferably fabricated of a generally rigid material of sufficient mass to prevent the device from falling over due to the weight of objects placed therein. Suitable materials include wood, wood products, plastics, hardened elastomers and metal. If desired, additional weight can be included in the base for added stability.

Mesh or netting 26 is mounted on the base for receiving the objects to be held. In the preferred embodiment, the mesh is an oriented netting of flexible thermoplastic material which has a resiliency or tendency to return to the shape in which it is formed. The mesh comprises a plurality of intersecting strands 27 with openings 28 between the stands. The size of the strands and the openings is selected in accordance with the weight and size of the objects to be held. In the oriented netting of the preferred embodiment, the mesh is initially made with openings of generally square or rectangular shape. While the material is still warm, it is drawn diagonally so that the openings acquire a diamond shape which they retain when the material is cooled. Thereafter, the material has a "memory" in that the strands tend to return to the diamond-shaped pattern when moved therefrom.

The netting or mesh employed in the preferred embodiments is manufactured in the form of an elongated cylindrical sleeve or tubing. This tubing is cut into desired lengths which are secured at their ends to the bases as hereinafter described.

In the embodiment of FIGS. 1–4, the ends of the mesh tubing are drawn together and secured to the central portion of the base. For this purpose, a bore 31 is formed in the base, and a plug 32 is mounted in the bore with the ends of the mesh being held between the plug and the wall of the bore.

As illustrated in FIGS. 1–4, the base is positioned with the plug down and the mesh extending from the lower side of the base. The mesh extends from the plug toward the periphery of the base, then upwardly past the base and above the upper surface. The mesh is arranged in inner and outer layers 36, 37 which come together in a curved fold 38 of generally semi-toroidal curvature above the base.

In operation and use, the holding device of FIGS. 1–4 is placed on a suitable supporting surface (not shown) such as a desk top, with the mesh in the position shown. Objects to be held, such as pencils and other writing implements, are inserted through openings 28 and gripped or held by the strands which define the openings. The objects can be inserted at any desired angle, and they are preferably inserted so that they extend through at least two openings in general alignment with each other.

The embodiment of FIGS. 5–8 is identical to that of FIGS. 1–4 except for the relative positions of the base and mesh. In this embodiment, the base is inverted, and surface 22 rests upon the supporting surface (not shown). The inner and outer layers 36, 37 of the mesh extend upwardly from the central portion of the base toward a crown region 39, then back down toward the base. In this embodiment, curved fold 38 is positioned adjacent to the periphery of the base.

Figure 8:
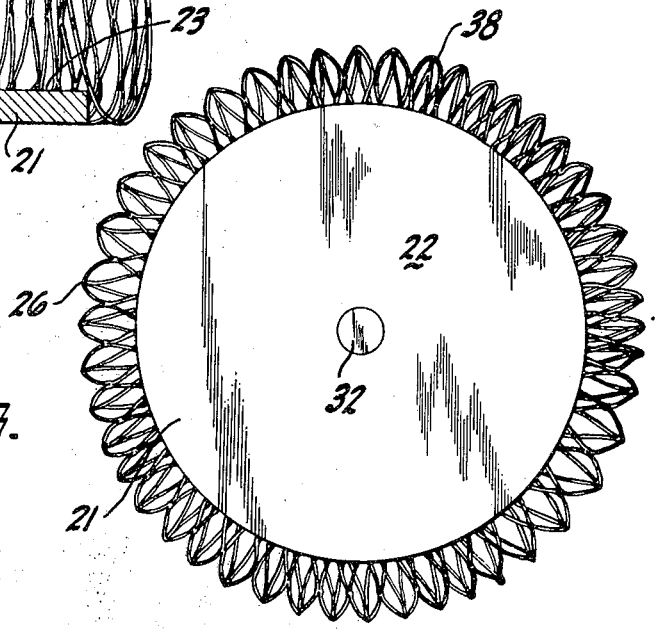
FIG. 8 is a bottom plan view of the holding device with the netting or mesh in the alternate postion.

In the embodiment of FIG. 8, both ends of the mesh tubing are secured to the periphery of the base. In this embodiment, the peripheral edge 41 of the base is tapered or bevelled, and the ends of the mesh are secured to the base by a retaining ring or band 42. The inner and outer layers of the mesh extend upwardly from the periphery of the base, and curved fold 38 is positioned above the base as in the embodiment of FIGS. 1–4.

Figure 9:
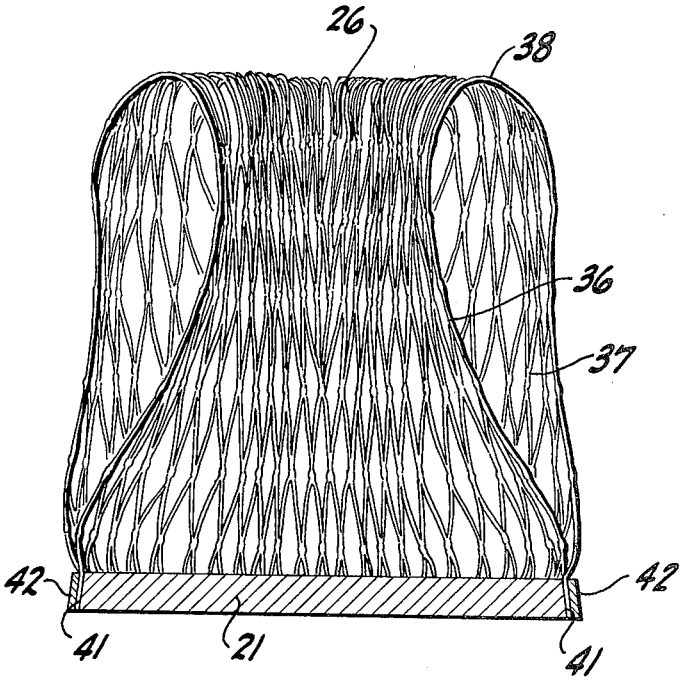
FIG. 9 is a vertical sectional view of a second embodiment of a holding device according to the invention.
Figure 10:
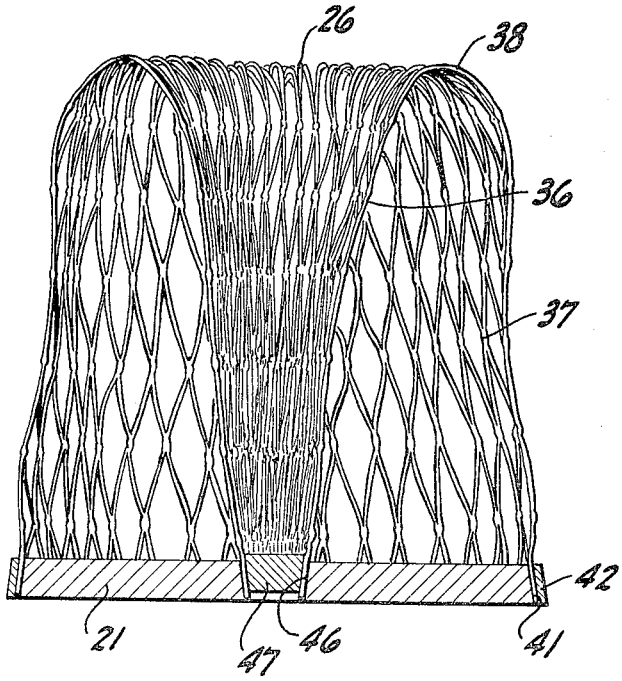
FIG. 10 is a vertical sectional view of a further embodiment of a holding device according to the invention.

In the embodiment of FIG. 10, one end of the mesh is secured to the central portion of the base, and the other end is secured to the periphery. The peripheral edge 41 of the base is bevelled or tapered as in the embodiment of FIG. 9, and the lower end of outer mesh layer 37 is secured to the bevelled edge by a retaining ring or band 42. The lower end of inner layer 36 is drawn together and secured in a central bore 46 by a tapered plug 47. As in the embodiments of FIGS. 1–4 and 10, fold 38 is spaced above the base.

Operation and use all of the embodiments is similar in that the pencils or other objects to be held are inserted through openings 28 and gripped by the strands 27 which define the openings. As mentioned previously, each object is preferably inserted through at least two openings in general alignment with each other.

It is apparent from the foregoing that a new an improved holding device for pencils and the like has been provided. While only certain presently preferred embodiments have been described, as will be apparent to those familiar with the art, certain changes and modification can be made without departing from the scope of the invention as defined by the following claims.

What is claimed is:

1. In a device for holding an elongated object: a generally planar base, an axially elongated tubing of flexible material folded back on itself to form inner and outer axially extending layers with a curved fold between the layers, and means including a plug mounted in a central bore in the base securing the ends of the tubing to the base with the axis of the tubing extending in a direction generally perpendicular to the plane of the base, said tubing comprising mesh of flexible strands joined together to form openings for receiving the elongated object in such a manner that the object extends through at least two of the openings and is gripped by the strands defining said openings, the mesh toward at least one end of the tubing being drawn together and secured in the bore by the plug.

2. The device of claim 1 wherein the mesh comprises an oriented thermoplastic netting.

3. The device of claim 1 wherein both ends of the tubing are secured to the central portion of the base.

4. The device of claim 1 wherein one end of the tubing is secured to the central portion of the base and the other end is secured to the peripheral portion.

5. The device of claim 1 wherein both ends of the tubing are secured to the central portion of the base and the inner and outer layers extend outwardly along the lower side of the base and upwardly past the base, the curved fold being spaced above the base.

6. The device of claim 1 wherein the inner and outer layers are folded back on themselves to form a second curved fold which is spaced from the base, the first named curved fold being positioned adjacent to the periphery of the base.

7. The device of claim 1 wherein the mesh toward one end of the tubing extends peripherally of the base, and the means securing the tubing to the base also includes a retaining ring securing the mesh peripherally to the base.

8. In a device for holding an elongated object: an axially elongated tubing of flexible mesh folded back on itself to form inner and outer axially extending layers with a curved fold between the layers, a base member adapted to rest on a generally planar mounting surface, and a plug mounted in a central bore in the base, with the mesh toward at least one end of the tubing being drawn together and secured in the bore by the plug, said mesh comprising an oriented netting having a plurality of strands joined together to form openings for receiving the elongated object in such manner that the object extends through at least two of the openings and is gripped by the strands defining the two openings.

9. The device of claim 8 further including a ring disposed peripherally of the base, with the mesh toward one end of the tubing being secured between the ring and the base.

* * * * *